US005846107A

United States Patent [19]

Widmann

[11] Patent Number: 5,846,107

[45] Date of Patent: Dec. 8, 1998

[54] MARINE ENGINE NOISE SUPPRESSOR

[75] Inventor: George F. Widmann, Clearwater, Fla.

[73] Assignee: ECO Sound Inc., Tarpon Springs, Fla.

[21] Appl. No.: 880,143

[22] Filed: Jun. 20, 1997

[51] Int. Cl.[6] ..... B63H 21/32

[52] U.S. Cl. ..... 440/89; 181/238

[58] Field of Search ..... 440/89; 181/235, 181/238

[56] References Cited

U.S. PATENT DOCUMENTS

| | | | |
|---|---|---|---|
| 4,002,136 | 1/1977 | Michalak | 440/89 |
| 4,977,977 | 12/1990 | Von Widmann et al. | 440/89 |
| 5,094,640 | 3/1992 | Burdick et al. | 440/89 |

*Primary Examiner*—Jesus D. Sotelo
*Attorney, Agent, or Firm*—Harold D. Shall

[57] ABSTRACT

An exhaust system in a boat for an internal combustion engine in the boat with the conventional round exhaust manifold of the engine connected by a rectangular cross sectional exhaust pipe to an exhaust chamber. Within the exhaust chamber is a vacuum wedge having a top plate with a vertical opening therein with the top plate being connected at its forward end to the front wall of the exhaust chamber and its rearward end connected at its laterally edges to the hull at the junction of the transom and bottom of the hull and the rearward end portion, intermediate the lateral edges connected to the transom. The sides of the top plate being connected by side walls to the hull bottom. An opening is formed in the hull bottom and extends laterally between these side walls and from the transom forward to overly half of the vertical opening in the top plate so that the exhaust chamber is vented through the vacuum wedge when the boat is on plane. When not on plane, low speed exhaust pipes connect the exhaust chamber to the outside of the hull above the water line.

9 Claims, 5 Drawing Sheets

MARINE ENGINE NOISE SUPPRESSOR

BACKGROUND OF THE INVENTION

1. Field of the Invention

This invention relates to a structure for providing marine internal combustion engine exhaust noise suppression and more particularly to such a structure for an inboard engine that provides a negative back pressure to the engines exhaust at such times as the vessel containing the same is underway.

2. Description of Prior Art

Inboard marine engines are notoriously noisy, especially when being operated at higher R.P.M. to drive the vessel rapidly through the water. This noisy operation is extremely unattractive to occupants of the vessel and it is highly desirable to reduce this noise without reducing vessel efficiency. Further, regulatory bodies, in their desire to improve the environment are imposing emission standards on marine vessels. These standards not only regulate the contents of the emissions but also apply to the noise level of the emission. It is, therefore, highly desirable to provide an exhaust system that is noise reduction efficient without detracting from the vessels operating efficiently.

Previous attempts have not proven to be completely acceptable from both the operating efficient and noise reduction efficiency standpoint. One such attempt, as shown in U.S. Pat. No. 4,002,136 while directing the exhaust into the water does not provide a structure which produces a sufficient reduction in pressure in the exhaust system to adequately ventilate the exhaust nor does it provide a structure in the exhaust system to suppress noise.

SUMMARY OF THE INVENTION

It is, therefore, an object of this invention to provide a structure for an exhaust system of an internal combination engine of a marine vessel which structure will provide an area of pressure which is reduced by the action of the vessel passing through the water and will direct the exhaust of the engine into the water and which structure will provide a chamber of reduced pressure into which the engine exhaust will pass and will expand and be noise suppressed prior to being exhausted, and will be further suppressed by being discharged against the passing water.

To fulfill the object, an exhaust chamber is provided at the rear of the vessel, the rear wall of which being the transom of the vessel, which chamber is confluently connected to the engines exhaust manifold from which it receives the exhaust gasses. Ports extend laterally from the chamber at a location above the vessel's water line and, at such time as the vessel is stationary or moving slowly, such ports emit the vessel's exhaust gasses from the chamber. At the rear (aft) midline of the vessel, a vacuum wedge is formed in the chamber at a level below the vessels stationary water line. The top of the wedge is inclined rearwardly from the front wall of the chamber and terminates at the vessels transom. A portion of the transom below the water line is omitted at the location of the wedge, and a portion of the bottom of the hull, below the vacuum wedge, is omitted. The top wall of the vacuum wedge has a pair of laterally spaced openings therein which are positioned so that vertical lines through the centers of the openings define a plane which registers with the forward end of the opening in the bottom of the hull. The front of the chamber is forward of the opening in the hull. As the vehicle speed increases, water flowing past the opening in the hull creates reduced pressure in the vacuum wedge and in the exhaust chamber so that the exhaust commences to move through the vacuum wedge and out of the vessel through the bottom opening in the hull. As the vessel reaches planing speeds, the pressure reduction (negative pressure) becomes substantial, and all the exhaust passes out through the opening in the bottom of the hull.

The conventional exhaust manifold from marine engines is round. As a part of this invention the rear portion of the exhaust manifold are connected to a rectangular pipe of larger cross sectional area than the round portion so that as the exhaust gases enter the rectangular pipe they expand. The rectangular pipe then curves inwardly to the exhaust chamber and enters the chamber to provide a further expansion of the exhaust gasses. The cross sectional area of the exhaust chamber is then much greater than the cross sectional area of the rectangular pipe to provide for further expansion of the exhaust gasses prior to being discharged from the chamber. This expansion of the exhaust gasses, coupled with the rectangular shape of the pipe segments and the exhaust chamber causes a substantial reduction of the exhaust noise, even at low speeds when the exhaust is discharged from the lateral ports, which are also rectangular in cross section and increasing in cross sectional area.

The details of construction of the above described structure provides great operating efficiencies over the structure of U.S. Pat. No. 4,002,136 and the rest of the prior art.

DETAILED DESCRIPTION OF THE PREFERRED EMBODIMENT

Figure 1:
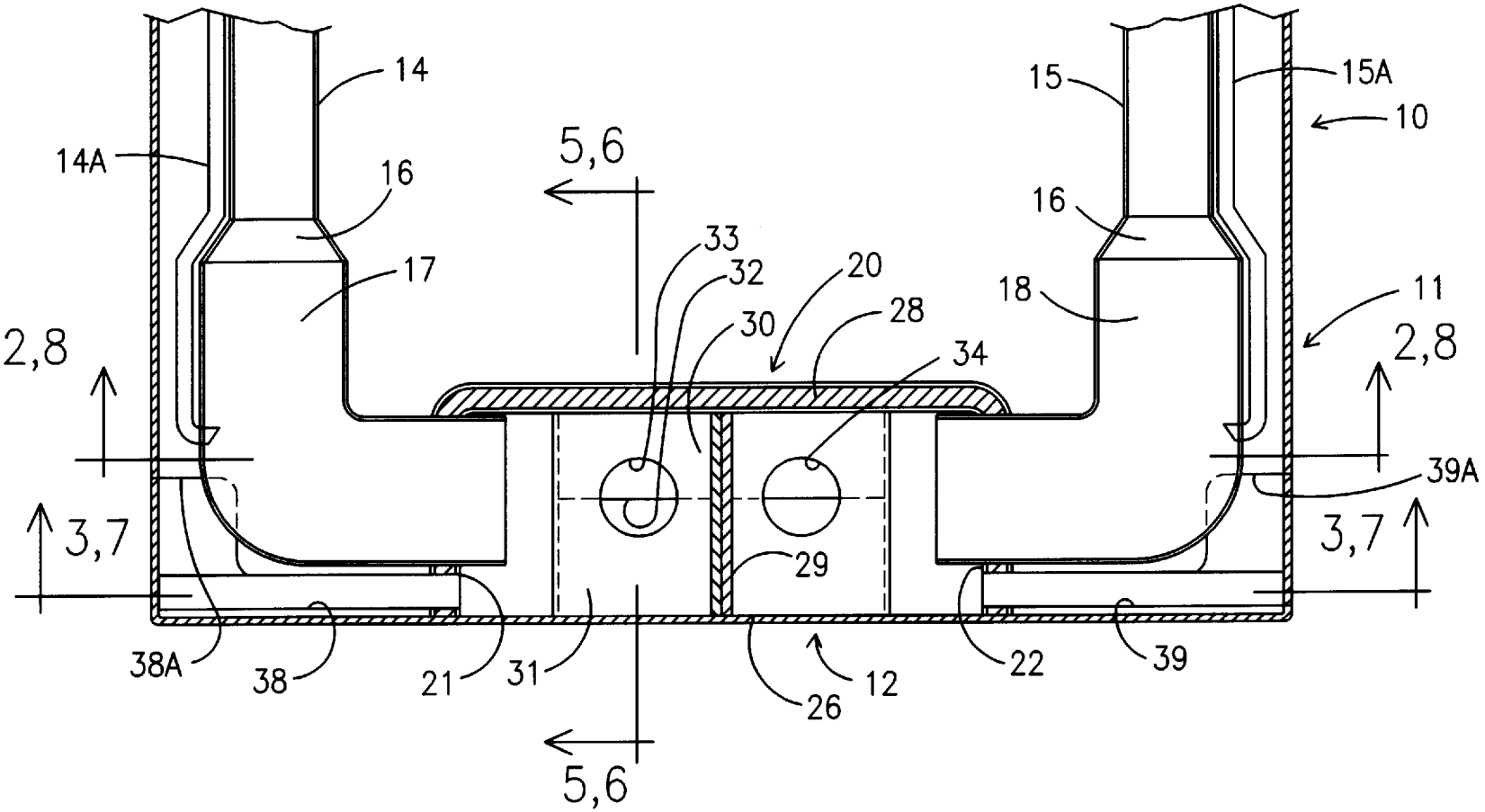
FIG. 1 Is a longitudinal sectional view taken along the line 1—1 in FIG. 4.
Figure 2:
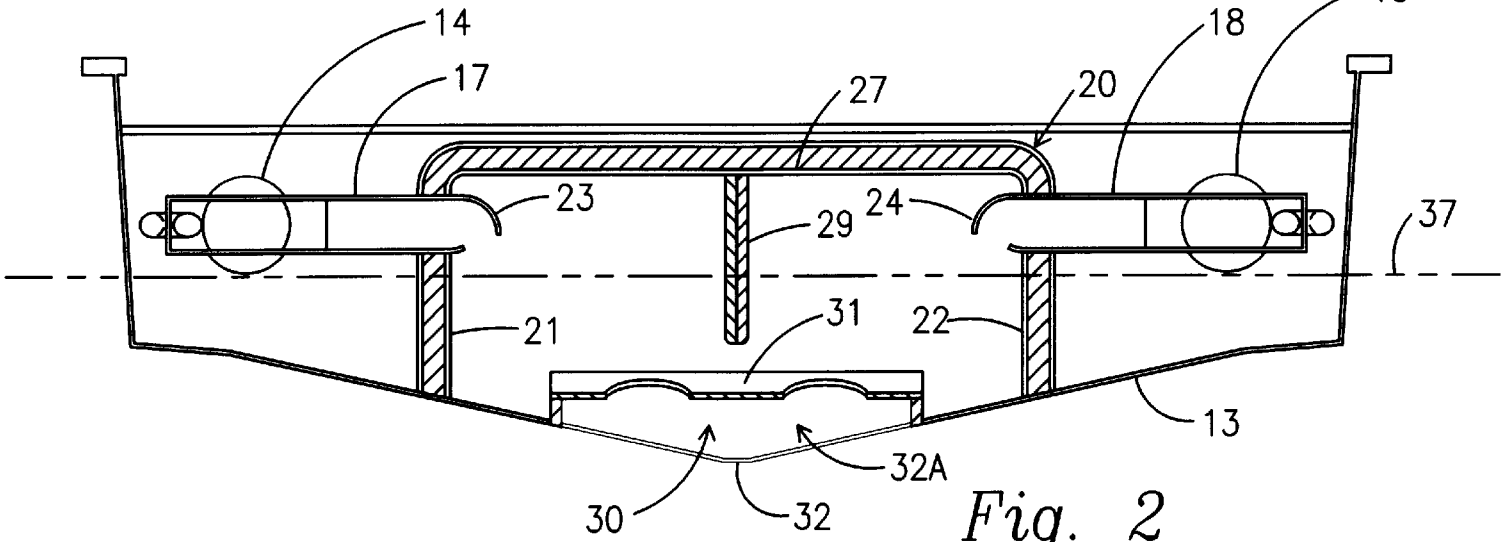
FIG. 2 Is a cross sectional view taken along the lines 2—2 in FIG. 1.
Figure 3:
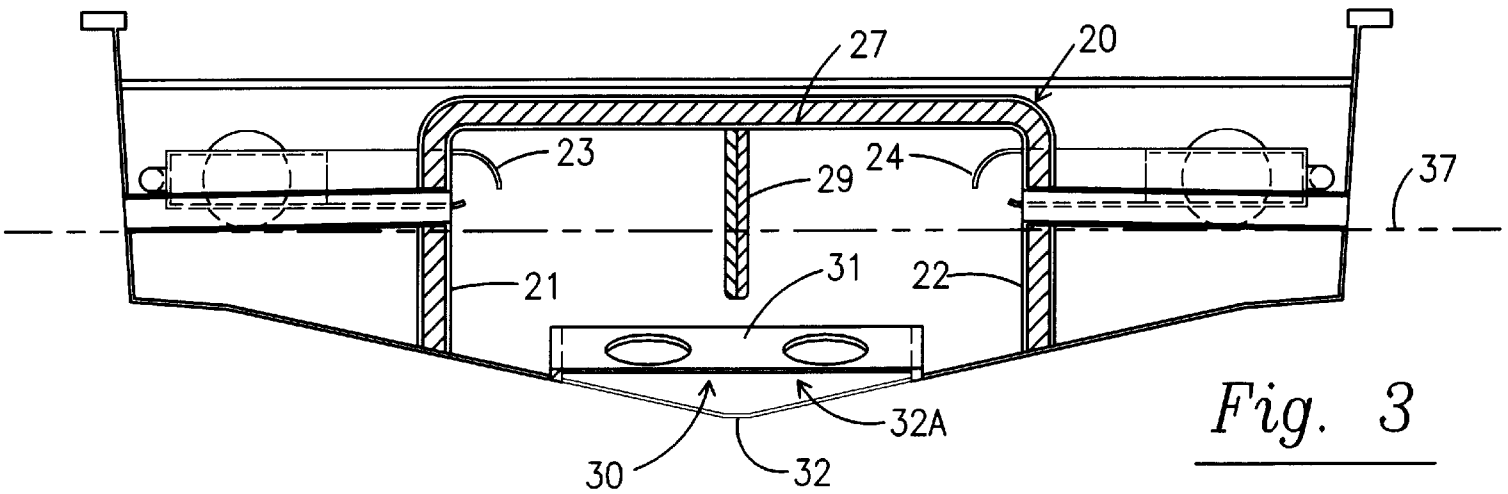
FIG. 3 Is a cross section view taken along the lines 3—3 in FIG. 1.

Referring now to the drawings, a boat is shown fragmentally at 10 and has a hull side 11, a transom 12, and a hull bottom 13. The boat 10 shown in the drawings has dual exhaust manifolds 14 and 15 leading from the vessels internal combustion engines for propelling the same; however, this invention will work equally well with single manifold and the below described revision to the structure shown. The manifolds 14 and 15 are of conventional round or substantially round configuration and extend rearwardly where they are each connected by a flared section 16 to a rearwardly extending rectangularly shaped exhaust pipe 17 and 18 respectively, and the latter are each bent inwardly to enter the lateral sides of an exhaust chamber 20 near the forward top of the side walls 21 and 22 of the chamber above boats water line 37. The exhaust manifolds 14A and 15A from auxiliary equipment also enter the pipes 17 and 18. As seen in FIGS. 2 and 3, a top lip 23 and 24, respectively at the inner end of the exhaust pipes 17 and 18 are curved downwardly so that when exhaust from the pipes enters the chamber 20, it is directed downwardly. This deposits any oil or liquid carbon particles in the exhaust gasses on top of the water within the chamber 20, as seen in FIG. 2, when combustion is not efficient as when the vessel is idling or moving at slow speeds.

At higher engine R.P.M. when cruising, combustion is more efficient and the reduced particular emissions pass out with the exhaust gasses. The manifolds 14 and 15 and the exhaust pipes 17 and 18 are above the water line of the boat 10 when is at rest.

The exhaust chamber 20 has an aft wall 26 which is the back wall of the vessel. On an original installation, the wall 26 would be the original transom of the vessel whereas if this is an aftermarket or add on device, it could be a wall aft of the original transom added for this purpose or the chamber can be installed in front of the original transom as disclosed herein. The chamber has a top wall 27 a forward wall 28 and a pair of side walls 21 and 22, with the top, forward, and side wall junctions being rounded so that sound is not trapped in the corners as could be the case if the junctions were at right angels. Midway in the chamber 20, a middle wall or baffle 29 extends downwardly, from the top wall a little more the one half the distance of the side walls 21 and 22. This baffle divides the chamber in half for sound attenuation purposes. If the vessel only has one engine with one exhaust manifold 14 or 15, it would only need one pipe 17 or 18, and half the chamber 20 as shown and would need no baffle 29 and only one half of the exhaust vacuum wedge hereinafter described.

Figure 4:
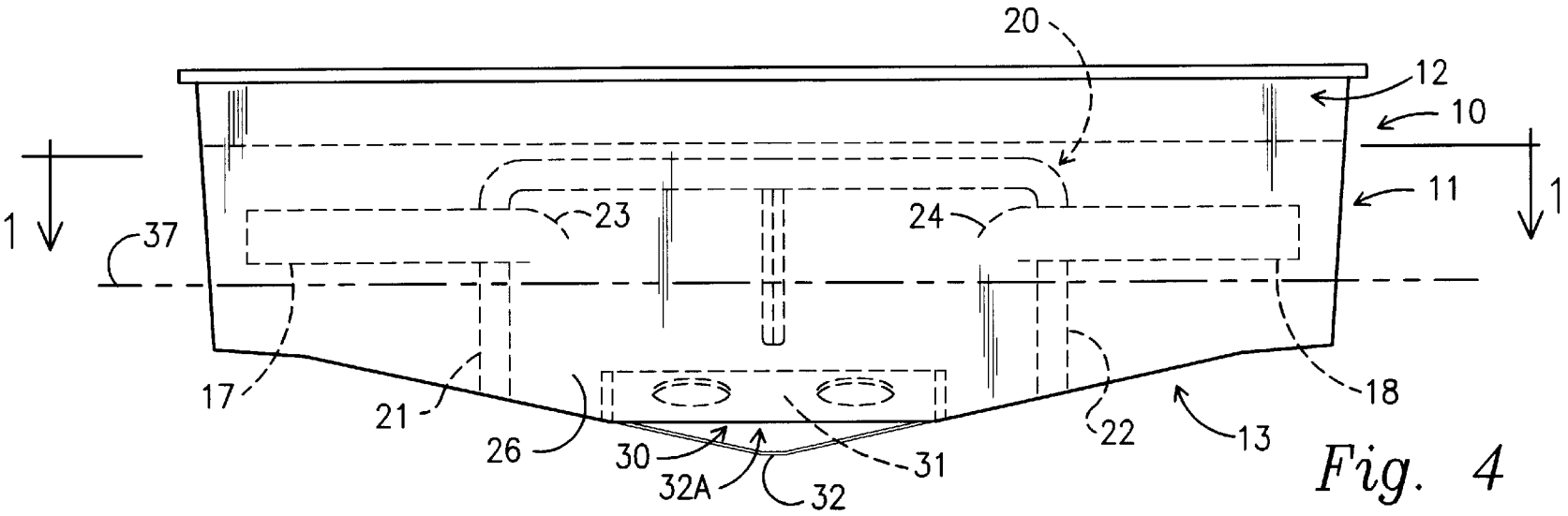
FIG. 4 Is a rear elevational view of the transom of a boat incorporating this invention.
Figure 6:
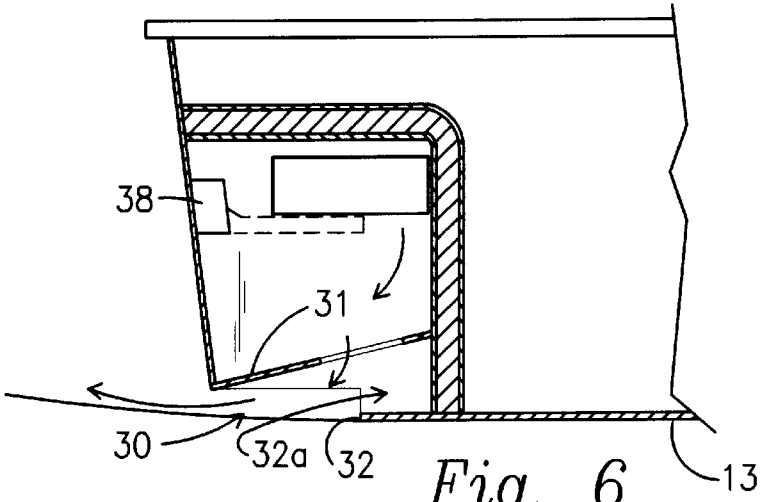
FIG. 6 Is a view like FIG. 5 showing the condition therein when the boat is on plane.
Figure 5:
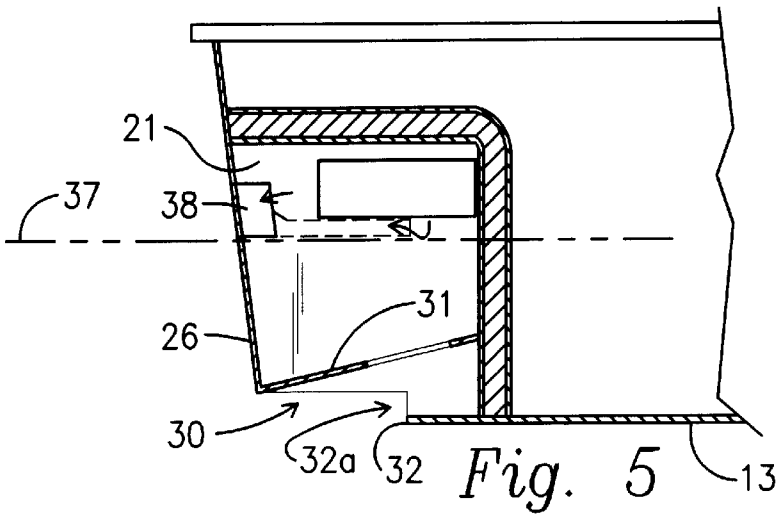
FIG. 5 Is a cross sectional view taken along the lines 5—5 in FIG. 1 showing the condition therein when the boat is at rest.

An exhaust vacuum wedge shown generally at 30 is provided in the rear of the hull bottom 13 within the exhaust chamber 20. More particularly, a wedge plate 31 is positioned within the chamber 20 with its forward end secured to the forward wall 28 at a location above the hull bottom 13 and extends rearwardly and downwardly to the transom 26 where it is secured to the latter. The wedge plate 31 has a pair of laterally spaced downwardly extending openings 33 and 34 therethrough. As seen in FIGS. 4, 5 and 6, a portion of the transom, below the junction of the transom and the wedge plate 31, is removed to form the rear of the vacuum wedge 30, additionally, the rear bottom of the hull is omitted aft of the location 32 to form an exhaust outlet 32A, which location is positioned on a vertical plane which passes through the centers of the openings 33 and 34. The sides of the wedge plate 31 have angular side walls 35 and 36 which are joined at their forward ends to the forward wall 28, on their tops to the plate 31, on their bottom to the hull bottom 13 on the sides of the exhaust outlet 32A and their aft tip, to the transom 12.

Figure 7:
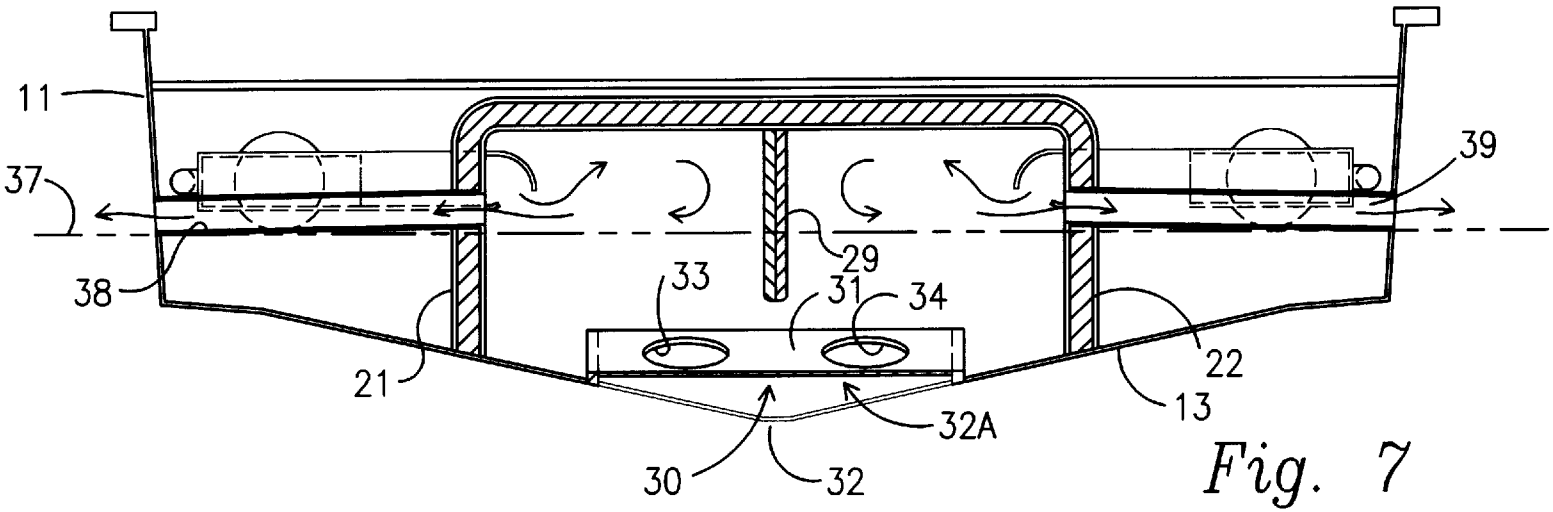
FIG. 7 Is a view taken along the lines 7—7 in FIG. 1 showing the condition when the boat is at rest.
Figure 8:
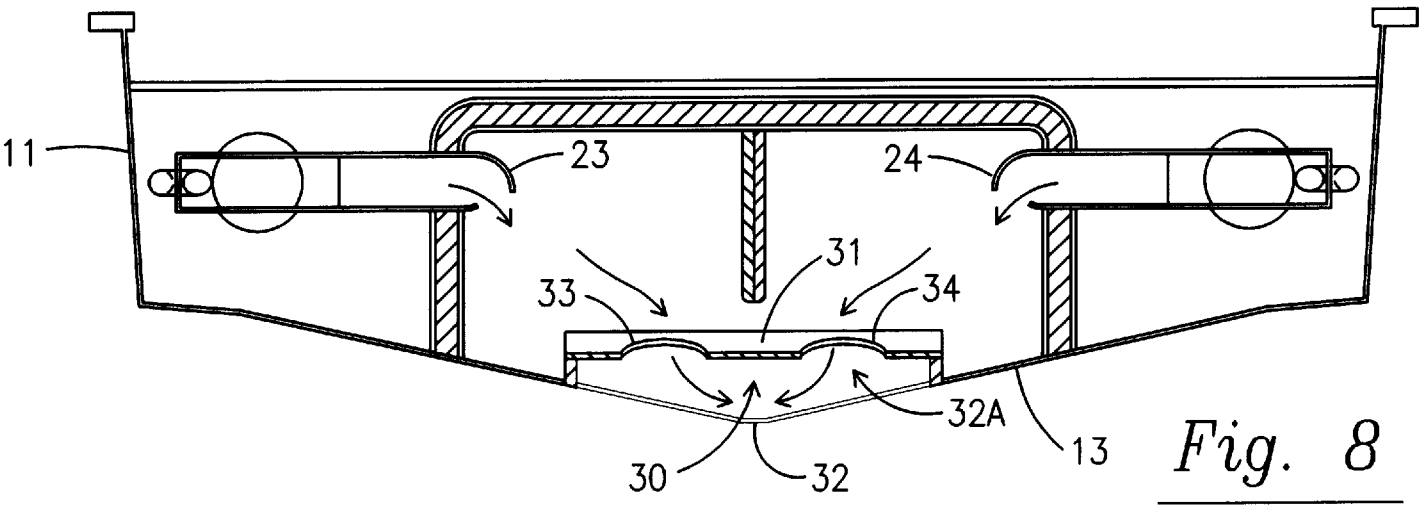
FIG. 8 Is a view taken along the lines 8—8 in FIG. 1 showing the condition when the boat is on plane.

When the boat 10 is at rest, water enters the chamber 20 as shown by the water line 37 as seen in FIGS. 2, 3, 4, 5 and 7 and at such time exhaust cannot flow out of the exhaust outlet 32A; however, at this time the exhaust gasses flow out of the low speed exhaust pipe 38 and 39 (see FIG. 7). The exhaust pipes 38 and 39 extend from chamber 20 through the side walls at a location above the water line 37 and extend to and through the sides of the hull 11 above the water line 37. The pipes 38 and 39 are rectangular in cross section for noise reduction purposes and have rectangular outlets 38A and 39A, respectively, through the hull 11, which outlets 38A and 39A are larger in cross sectional area than the pipes 38 and 39 for noises reduction.

At idle and low speeds, because the openings 33 and 34 are below water, there is a positive pressure within the chamber 20 forcing the exhaust gasses out through the pipes 38 and 39. At high speed operation, when the vessel comes on plane, the exhaust outlet 32A becomes uncovered and the water rushing past the exhaust opening provides a negative pressure through the openings 33 and 34 to the chamber 20 and the exhaust is drawn out of the exhaust opening 32A and onto the water streaming therepast.

Figure 9:
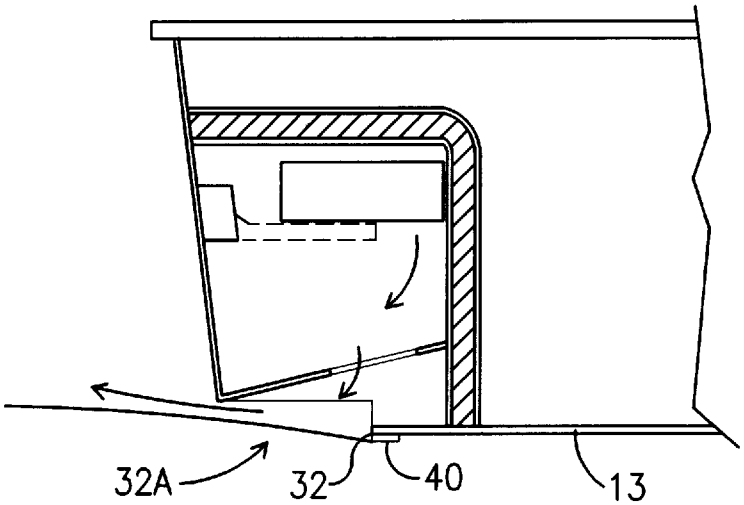
FIG. 9 Is a view taken like FIG. 6 of another embodiment of this invention.

As seen in FIG. 9, if increased negative pressure is desired at the exhaust outlet 32A and therethrough to the chamber 20, a laterally extending lip 40 can be secured to the hull bottom 13 immediately forward of the location 32 for the lateral width of the exhaust outlet 32A. This lip 40 causes an increase in the pressure reduction induced within the vacuum wedge 30 as the planing vessel passes through the water.

An example of the size relationship of the various elements of this exhaust system is as follows: with twin engine application of Caterpillar 3208 DI-DA D353210-425 HP engines, the total width of the exhaust chamber 20 was 38 inches, height was 24 to 38 inches and the distance of 14 inches from the front wall 28 to the transom 26. The manifolds 14 and 15 were from 5 to 8 inches in diameter; the exhaust pipes 17 and 18 were 10×10 inches; the low speed exhaust pipes 38 and 39 were 2×3 inches; the wedge plate 31 was 18 inches wide by 13 inches long, with the front end elevated 5 inches; and the area of each of the openings 33 was 64 square inches and could be round, square or round cornered square in configuration. An application within the above parameters has been tested and found to operate satisfactorily.

Another satisfactory application provided this size relationship; Caterpillar 3208 DI-DA D353 210-425 HP single engine; the width of the exhaust chamber was 16 to 25 inches; the height 24 to 38 inches; the distance from the front wall 28 to the transom 26 was 14 inches; the manifold was 5 to 8 inches; the exhaust pipe 10 inches by 10 inches; the low speed exhaust was 2×3 inches; the wedge plate 31 was 18 inches wide, by 13 inches long with the front end elevated 5 inches; and the area of the opening 33 was 150 square inches.

Although the above description relates to a presently preferred embodiment and a modification thereof, numerous changes can be made therein without departing from the scope of this invention is claimed in the following claims.

What is claimed is:

1. An exhaust system for an internal combustion engine of a boat having a planing hull with a bottom surface and with a rear hull wall at its rearward end and a stationary water line above the lower surface of said hull comprising, a) an internal combustion engine having an exhaust manifold, b) an exhaust chamber in said hull, with said chamber having a forward wall, a top wall, a pair of spaced side walls and with said rear hull wall forming the rear wall of said chamber and with said bottom surface of said hull forming the bottom of said chamber, c) conducting means connecting said exhaust manifold to said exhaust chamber at a level above the water line of said hull, d) a vacuum wedge in said exhaust chamber having i) a wedge plate having a front edge, a rear edge and a pair of side edges, with said front edge being connected to said forward wall at a location above said lower surface of said hull and extending angularly rearwardly and downwardly therefrom and with said rear edge directly connected to the junction of said rear hull wall and said lower surface of said hull, ii) said wedge plate having a first vertically extending opening therein intermediate the front and rear edges thereof, and iii) said lower surface of said hull having a hull opening open beneath said wedge plate whereby said vacuum wedge provides a high speed exhaust path from said exhaust chamber through said hull opening, and e) low speed exhaust path means connecting to said exhaust chamber at a location above said stationary water line extending to open outside said hull at a location above said stationary water line.

2. A system according to claim 1 wherein said hull opening has a forward and a rear end with said forward end lying in a vertical plane which passes through the center of the vertically extending opening in said wedge plate and the rearward end of said hull opening extends to said rear hull wall.

3. A system according to claim 1 wherein said exhaust manifold is substantially round in cross section, said conducting means is rectangular in cross section, flared section means connects said round and rectangular sections and said rectangular section has a greater cross sectional area than the cross sectional area of said substantially round section.

4. A system according to claim 3 wherein said low speed exhaust path means in rectangular in cross section.

5. A system according to claim 3 wherein said conducting means extends into said exhaust chamber and has a rearward end projecting into said chamber, and said rearward end has a down turned top lip.

6. A system according to claim 1 wherein said engine means has a second exhaust manifold and a second conducting means connecting said second exhaust manifold to said exhaust chamber.

7. A system according to claim 6 wherein said first conducting means and said second conducting means connect to said exhaust chamber on the lateral sides thereof, said exhaust chamber has a baffle means therein between said first and second conducting means and said wedge plate has a second vertically extending opening, with said first and second vertical openings being on opposite lateral sides of said baffle means.

8. A system according to claim 7 wherein said baffle means is an intermediate wall connected to the top, front and rear walls of said exhaust chamber and spaced above said wedge plate.

9. A system according to claim 3 including a lip formed on the bottom of said hull immediately forward of said hull opening.

* * * * *